US006305207B1

(12) United States Patent
Jakoby

(10) Patent No.: US 6,305,207 B1
(45) Date of Patent: Oct. 23, 2001

(54) REMOVING SHELL AND PRESS RESIDUE FROM A METAL-EXTRUDING RAM DISK OR DIE

(75) Inventor: Nikolaus Jakoby, Ratingen (DE)

(73) Assignee: SMS Eumuco GmbH, Leverkusen (DE)

( * ) Notice: Subject to any disclaimer, the term of this patent is extended or adjusted under 35 U.S.C. 154(b) by 0 days.

(21) Appl. No.: 09/486,274

(22) PCT Filed: Jul. 28, 1998

(86) PCT No.: PCT/DE98/02129

§ 371 Date: Mar. 13, 2000

§ 102(e) Date: Mar. 13, 2000

(87) PCT Pub. No.: WO99/10114

PCT Pub. Date: Mar. 4, 1999

(30) Foreign Application Priority Data

Aug. 22, 1997 (DE) ..... 197 36 505

(51) Int. Cl.[7] ..... B21C 23/00
(52) U.S. Cl. ..... 72/255
(58) Field of Search ..... 72/254, 255, 273.5; 83/168

(56) References Cited

U.S. PATENT DOCUMENTS 3,373,592 * 3/1968 Robra et al. ..... 72/255
4,043,163 * 8/1977 Raab ..... 72/255
4,048,832 * 9/1977 Raab et al. ..... 72/255
4,745,789 5/1988 Richardt et al. .
4,750,345 * 6/1988 Groos et al. ..... 72/255

FOREIGN PATENT DOCUMENTS 25 05 160 A1 8/1976 (DE) .
25 06 447 8/1976 (DE) .
26 13 241 A1 10/1977 (DE) .
0 224 115 B1 4/1991 (EP) .
55-128317 * 10/1980 (JP) ..... 72/254

* cited by examiner

*Primary Examiner*—Ed Tolan
(74) *Attorney, Agent, or Firm*—Herbert Dubno; Andrew Wilford

(57) ABSTRACT

Pressing residue and shell are stripped from a metal-extruder disk having a pair of parallel and flat end faces at least one of which carries pressing residue or shell and an annular outer periphery extending between the end faces and carrying shell. First the disk and a blade are relatively displaced such that the blade sweeps across one of the faces and scrapes any press residue or shell therefrom. Then the disk is rotated about an axis perpendicular to the end faces while a plurality of angularly offset rollers are pressed radially against the shell carried on the outer periphery while the disk is rotating to radially deform the shell and separate it from the outer periphery. The shell separated from the outer periphery is then transported away from the disk.

9 Claims, 5 Drawing Sheets

REMOVING SHELL AND PRESS RESIDUE FROM A METAL-EXTRUDING RAM DISK OR DIE

CROSS REFERENCE TO RELATED APPLICATIONS

This application is the US national phase of PCT application PCT/DE98/02129 filed Jul. 28, 1998 with a claim to the priority of German application 19736505.1 filed Aug. 22, 1997.

FIELD OF THE INVENTION

For shell-type extrusion of metals the ram disk or die ends up after an extrusion operation with residue on one end of the ram disk or die and with a shell connected to the residue and partly or wholly covering the ram disk or die according to the type of operation and the tool type, the shell collecting in an annular chamber on the outer edge of the ram disk or die or being compacted in a separate working step on the rear face of the ram disk or die opposite the residue. In order to reuse the ram disk or die the residue and shell must be removed.

BACKGROUND OF THE INVENTION

The removal of the pressing residue and if necessary of the shell compacted behind the ram disk or die is done by a blade run along the rear face of the ram disk or die and if necessary a second blade run along the opposite face carrying the compacted shell. The first blade forms together with the second blade or with a guide plate a frame in which the blade(s) and the guide plate have a spacing corresponding to an axial dimension of the ram disk or die and through which the ram disk or die is moved parallel to its end faces so that in this manner the residues (pressing residue and compacted shell) or the pressing residue on one end face are sheared off.

The shell portion surrounding the periphery of the ram disk or die or the shell crumpled into the annular chamber is cut by one or two groove blades mounted laterally in the frame of the press-residue separator so that the shell is scraped out by the groove blades and is pushed off the ram disk or die (DE 2,506,447 and DE 2,613,241).

Instead of fixed groove blades according to European 0,224,115 pivotally mounted groove blades are known which are advanced into the ram disk or die to scrape along its periphery and separate the shell.

OBJECTS OF THE INVENTION

It is an object of the invention to remove the shell from the ram disk or die more surely.

SUMMARY OF THE INVENTION

This object is attained by radially spreading the shell to be removed by roller pressure while rotating the ram disk or die whose end faces have been freed of residue (pressing residue and compacted shell) and rotating the roller or rollers braced radially against it and subsequently axially stripping the sufficiently spread shell.

The apparatus for carrying out the method is a frame formed of two blades or one blade and a guide plate at a spacing equal to the axial dimension of the ram disk or die, a press-residue remover comprised of a slide moving the ram disk or die parallel to the blade or blade according to a further feature of the invention, a spreading device provided with rotatably driven rollers radially displaceable against the ram disk or die and forming a central rotatable holder for the ram disk or die and for separate removal of the ram disk or die and the shell.

A preferred embodiment of the spreading device has three movable rollers. It is preferable here that the holder for a ram disk or die and the roller or rollers are arranged in a horizontal plane with vertical rotation axes.

BRIEF DESCRIPTION OF THE DRAWING

The drawings show an embodiment of the invention wherein.

SPECIFIC DESCRIPTION

Figure 1:
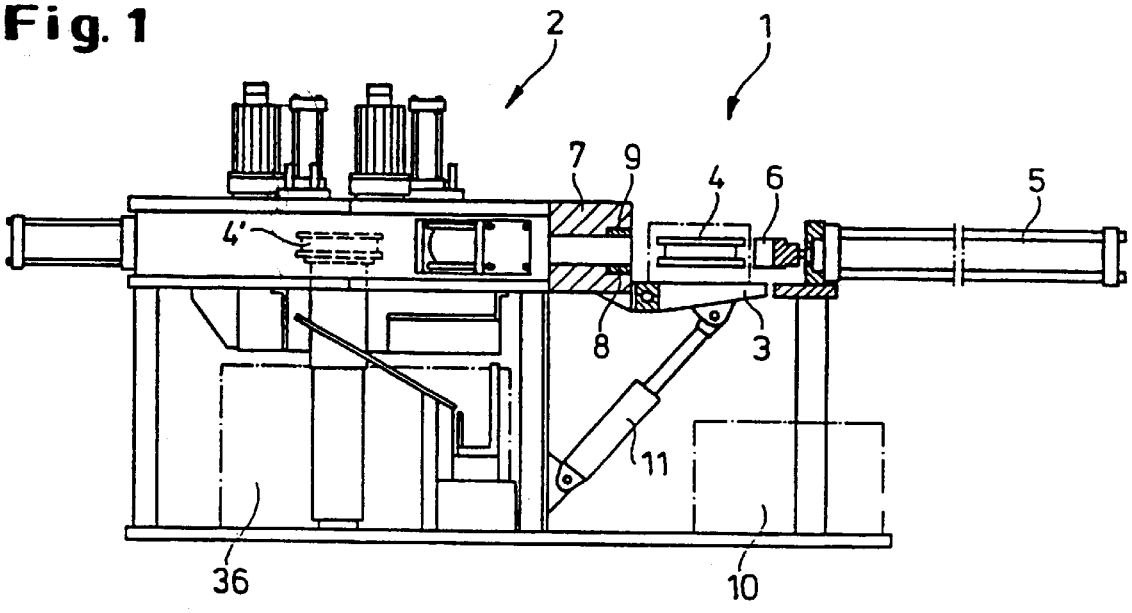
FIG. 1 is a side view.
Figure 2:
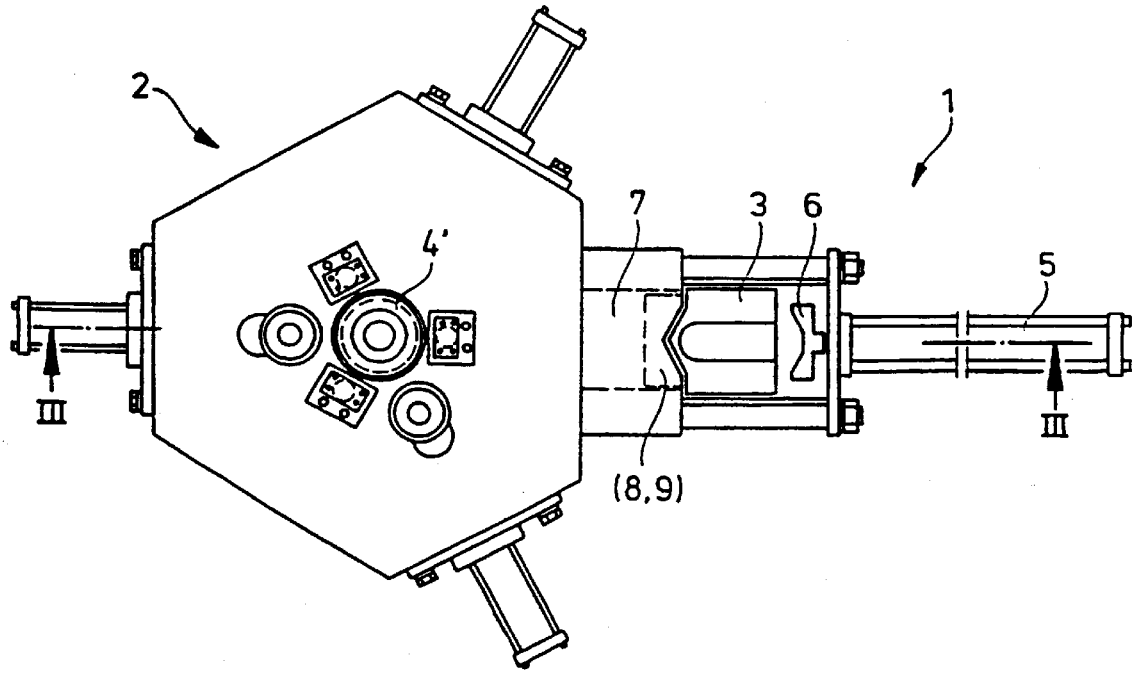
FIG. 2 is a top view of the overall apparatus.

The apparatus for removing the residue and shell from a ram disk or die used with shell-type metal extrusion has basically two parts, namely a shear 1 in which the residue on the one end face of the ram disk or die and if necessary the shell crumpled on the other end face is sheared off and a stripper 2 in which the shell which surrounds the ram disk or die is removed.

The shear 1 is formed as described in German 2,505,160 or European 0,224,115 and comprises a support table 3 on which is held the residue- and shell-carrying ram disk or die 4 fed in by an appropriate transport system from the extrusion press. Next to the support table 3 on one side is a slide pusher 6 movable by a piston-cylinder unit 5 and aligned on the opposite side is a frame 7 carrying a lower blade 8 and an upper blade 9. Appropriate actuation of the piston-cylinder unit 5 advances the slide 6 to the frame 7 and into same thereby sliding the residue- and shell-carrying ram disk or die 4 onto the system axis of the stripper 2 (position 4'). As the ram disk or die 4 enters the frame 7 the lower blade 8 shears off the residue on the lower face of the die 4 and, if the opposite end face is carrying a crumpled shell, the upper blade 9 shears off the crumpled shell from the upper end face of the ram disk or die 4 so that it is only left with shell wrapped around itself which can be removed in the stripper 2. The residue and shell left on the support table 5 is dropped into a scrap bucket 10, to which end the pivotally mounted support table 3 is swung down by a piston-cylinder unit 11.

Figure 3:
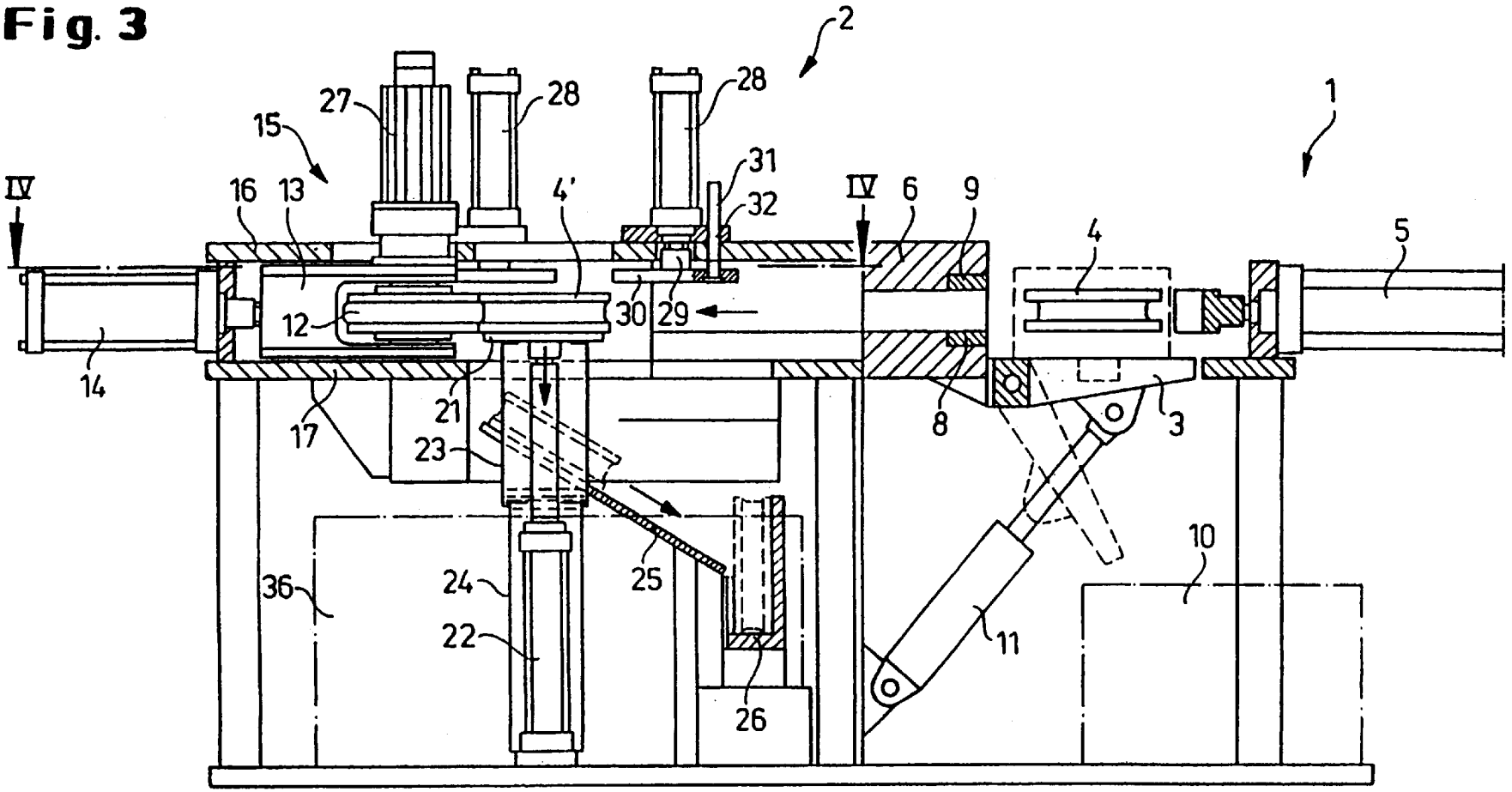
FIG. 3 is a large-scale section of the side view taken along line III—III of FIG. 2.
Figure 4:
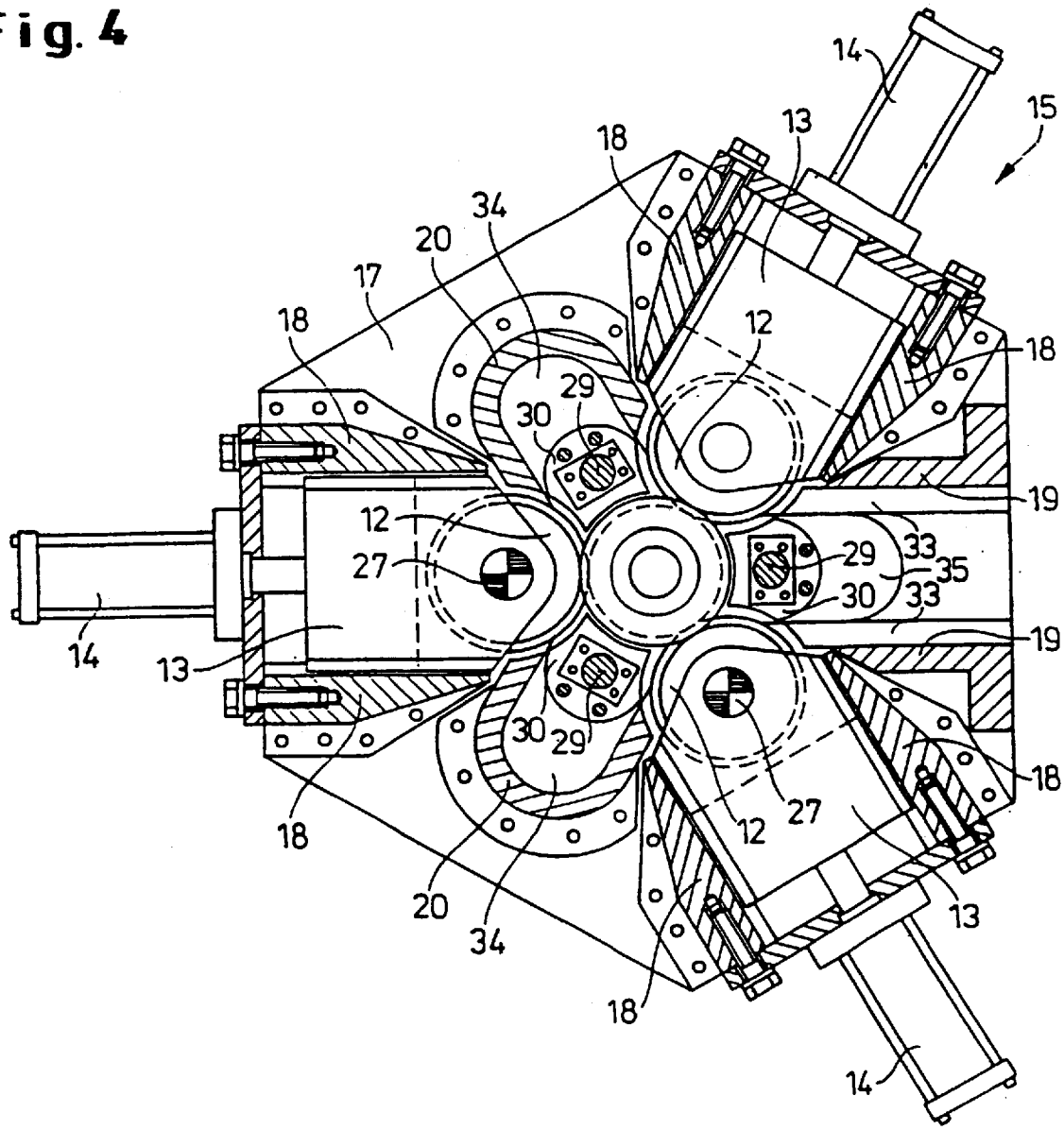
FIG. 4 is a large-scale section taken along line IV—IV of FIG. 3.

The stripper 2 acting as a spreading device is in the illustrated embodiment provided as shown in FIGS. 3 and 4 with three rollers 12 that are rotatably mounted in slides 13 and movable therewith by piston-cylinder units 14 radially to the system axis. At least one (here two) of the rollers 12 are driven by a respective hydraulic motor 27. The frame 15 carrying the rollers 12 with their slides 13 is formed by an upper plate 16 and a lower plate 17 and roller guides 18 formed along with slide guides 19 and chamber walls 20 as spacers therebetween.

A brace plate 21 can be moved in from below along the system axis and has an unillustrated turntable. The plate 21 is raised and lowered by a piston-cylinder unit 22 that is protected by a sleeve 23 which is in turn connected with the brace plate 21 and telescopes with an inner shield sleeve 24. The brace plate 21 is formed with lateral flats so it can be dropped through a fork-like stripper plate 25 and a ram disk or die 4 can be stripped of shell as it is dropped and moves into a trough 26 for transport back to the extrusion press.

Angularly centered between the rollers 12 are push rods 29 guided in cylinders 28 and each carrying a scraper plate 30 whose shape mainly is determined by the ram disk or die and two adjacent rollers 12. Each scraper plate 30 is provided with two guide rods 31 that slide in bores 32 of the upper plate 16 and in the mounting flanges of the respective cylinder 28.

Figure 5:
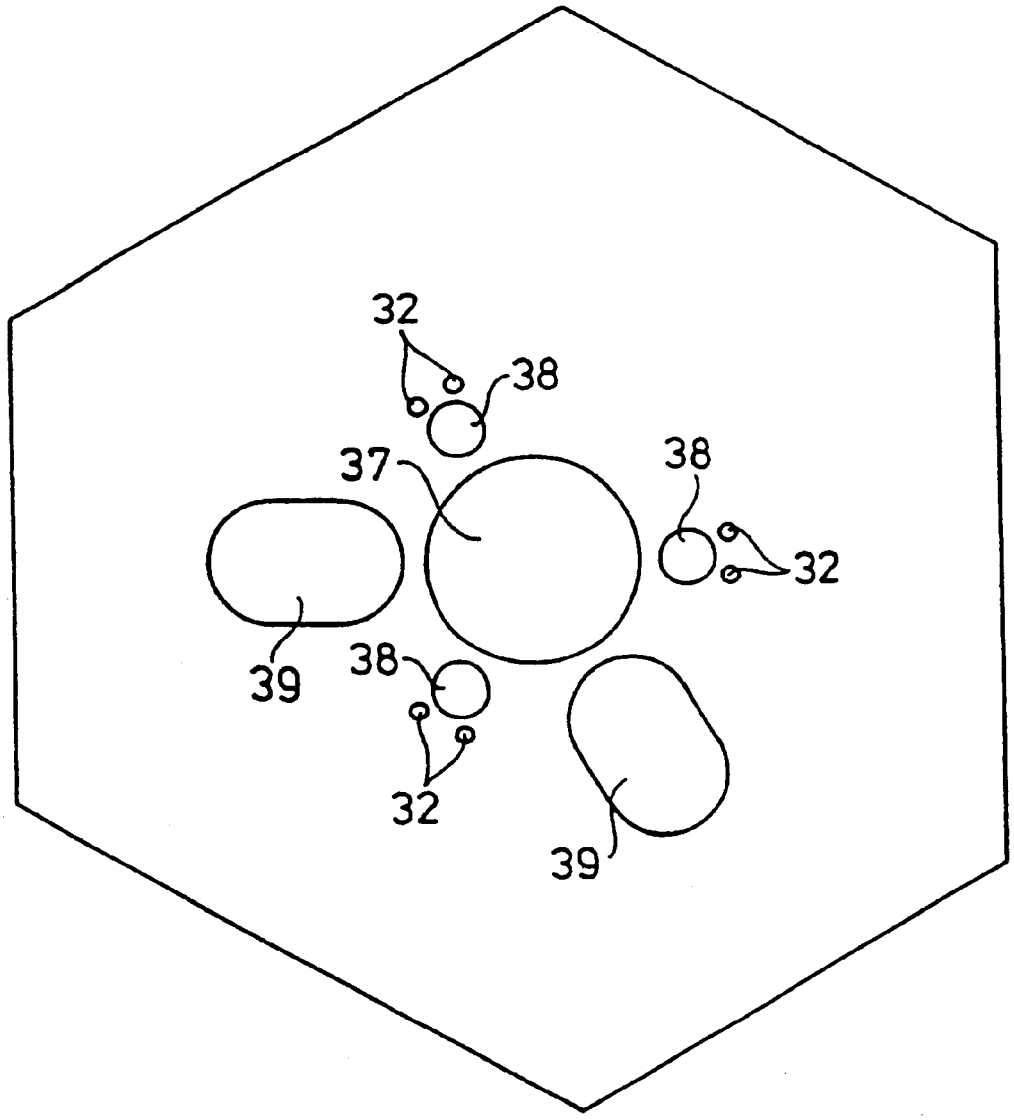
FIGS. 5 and 6 are detail views.
Figure 6:
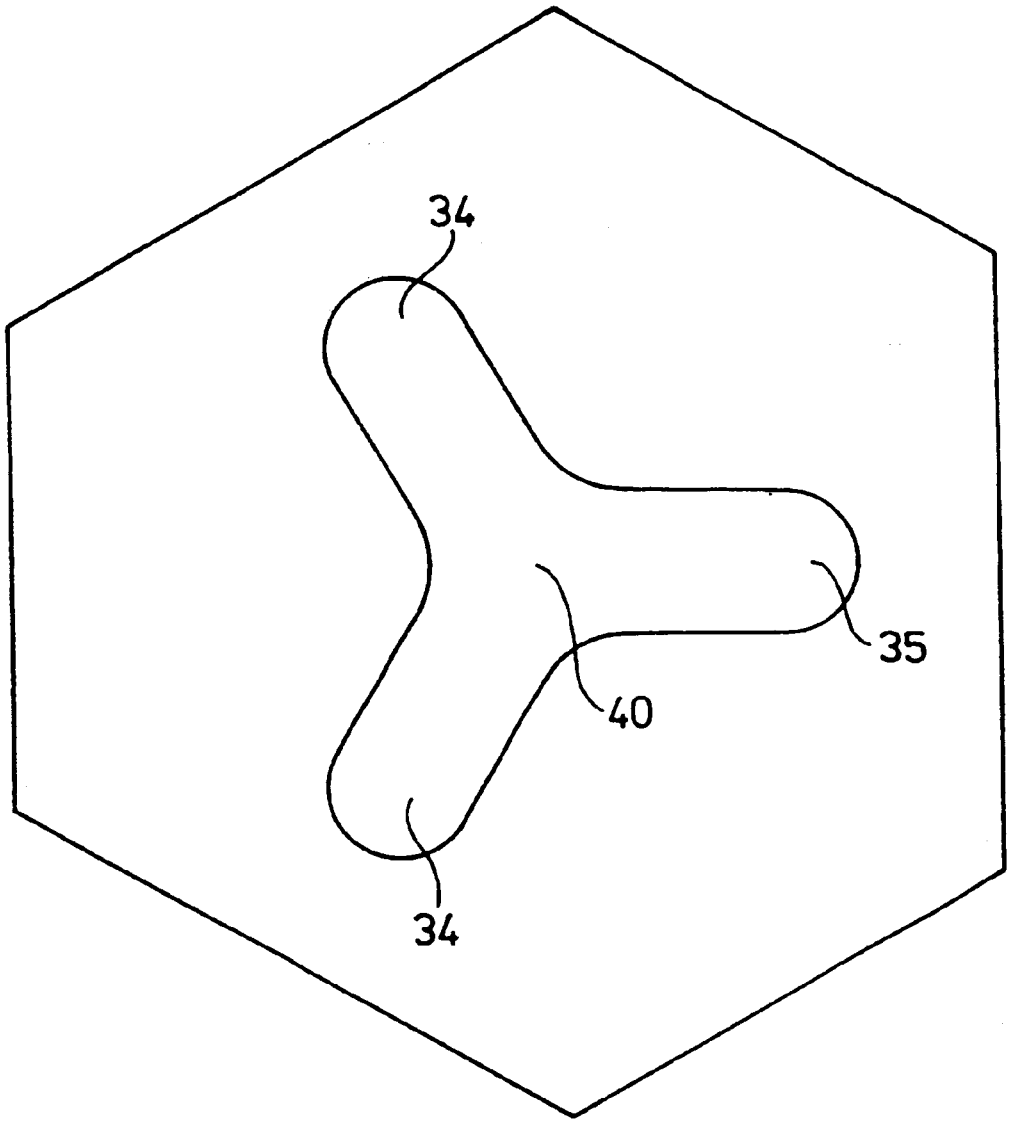

The upper plate 16 is shown in detail in FIG. 5 and the lower plate 17 in FIG. 6. Without showing the threaded holes for connection of the roller guides 18, the slide guides 19, and the chamber walls 20 with the upper plate 16 and lower plate 17, FIG. 5 shows a top view of the upper plate 16 with a central opening 37 through which the ram disk or die can be raised. Further shown are the bores 38 for the push rods 29 and the bores 32 for guiding the guide pins 31 as well as slots 39 for the motors 27 extending through the upper plate 16. FIG. 6 shows the lower plate 17 with its star-shaped opening 40 that includes a central aperture through which the brace plate 21 with the ram disk or die 4 passes and the openings 34 and 35 for removal of the shell scrap.

After a ram disk or die 4 is as described above advanced by the push slide 6 of the piston-cylinder unit 5 through the frame 7 with the lower blade 8 and the upper blade 9, further advance of the slide 6 puts the ram disk or die in the position 4' centered on the system axis of the stripper 2. To this end two of the rollers 12 are moved laterally out of the path of the ram disk or die 4 to a spacing equal at least to the diameter of the shell-covered ram disk or die 4. The slide guides 19 serve to laterally guide and bars 33 on the slide guides 19 and, on the last part of the path, the brace plate 21 in its upper position serve to support the ram disk or die 4.

As soon as the ram disk or die reaches the position 4' the three rollers are concentrically moved in and pressed against the ram disk or die 4 and then set to rotating. This roller action exerted on the shell serves to spread the shell that bulges out between the roller zones and separates from the periphery of the ram disk or die 4. The continuous rolling and bending action on the shell normally leads to rapid fracture of the shell and the pieces fall through one of the openings 34 below the chambers defined by the chamber walls 20 or through opening 35 between the guide bars 33 into a scrap bucket 36. If the shell material is very ductile so that the shell does not fracture, the stripping of the spread shell is effected by the scraper plates 30 moved by the push rods 29 and engaged with their edges between the rollers on respective peripheral sections of the ram disk or die 4 so as to comminute the shell. After removal of the shell or its pieces the ram disk or die 4 freed of residue and shell is sent back to the extruder by sinking of the brace plate 21.

Instead of proceeding as in the illustrated embodiment by sinking the brace plate 21 to send back the ram disk or die 4 freed of residue and shell, with appropriate construction of the bracing device this can be raised and it can be taken away from above the stripper 2 to the extrusion press which has the advantage that the removal of scrap and the taking-away of the ram disks or dies are separated.

Fracturing of the spread shell by rolling can be improved when the rollers are provided with cutting edges with grooves transverse to the rolling direction that cut into the shell, which requires stopping the rollers at a predetermined end position in order to avoid damage (grooving) of the ram disk or die. With ram disks or dies that are combined with a shell-stripping disk and where the shell can collect in an annular chamber ahead of the shell-stripping disk, it is recommended that the rollers have a ridge engaging in the annular chamber of the ram disk or die in order to groove the shell, the ridge diameter plus the cutting depth not exceeding the basic diameter of the roller more than the depth of the annular chamber so that when the roller contacts the ram disk or die the cutting edges do not reach the floor of the annular chamber. In this case however the cutting depth can be less than the shell thickness so that spreading of the shell by rolling is sufficient.

What is claimed is:

1. A method of stripping pressing residue and shell from a metal-extruder disk having a pair of parallel and flat end faces at least one of which carries pressing residue or shell and an annular outer periphery extending between the end faces and carrying shell, the method comprising the steps of:

relatively displacing the disk and a blade with the blade sweeping across one of the faces and scraping any press residue or shell therefrom;

rotating the disk about an axis perpendicular to the end faces;

pressing a roller radially of the axis against the shell carried on the outer periphery while the disk is rotating to radially deform and compress the shell against the disk at the roller and thereby free the shell from the outer periphery adjacent the roller; and thereafter axially relatively displacing the radially deformed and compressed shell and the disk and thereby separating the shell from the disk.

2. The stripping method defined in claim 1 wherein the disk is rotated about the axis by pressing a plurality of such rollers against it at angularly offset locations and rotatably driving at least one of the rollers.

3. The stripping method defined in claim 1 wherein the disk is displaced past a pair of such blades spaced apart by a distance equal to a spacing between the disk end faces, whereby pressing residue and shell is thereby scraped off both end faces of the disk.

4. An apparatus for stripping pressing residue and shell from a metal-extruder disk having a pair of parallel and flat end faces at least one of which carries pressing residue or shell and an annular outer periphery extending between the end faces and carrying shell, the apparatus comprising:

a frame carrying at least one blade;

means for displacing the disk and blade so that the blade sweeps across one of the faces and scrapes any press residue or shell therefrom;

means for positioning the disk centered on a system axis perpendicular to the end faces;

means for rotating the disk about the system axis;

a roller engageable radially against the shell carried on the outer periphery;

means for pressing the roller radially against the shell carried on the outer periphery while the disk is rotating to radially deform and compress the shell against the disk at the roller and thereby free the shell from the outer periphery adjacent the roller; and means for axially relatively displacing the freed shell and the disk to separate the shell from the disk.

5. The stripping apparatus defined in claim 4 wherein there are three such rollers generally angularly equispaced about the system axis each associated with a respective such pressing means.

6. The stripping apparatus defined in claim 5 wherein the system axis is vertical and the rollers are rotatable about respective axes parallel to the system axis.

7. The stripping apparatus defined in claim 5, further comprising means for radially outwardly displacing at least one of the rollers relative to another of the rollers to form between the one and other rollers a space sufficiently wide for the disk carrying shell on its outer periphery to pass through.

8. The stripping apparatus defined in claim 4 wherein the means for axially relatively displacing the freed shell and the disk includes stripping tools displaceable parallel to the system axis between the rollers for pushing away shell freed by the roller from the disk.

9. The stripping apparatus defined in claim 4, wherein the means for positioning includes a vertically displaceable support turntable.

* * * * *